US005443194A

United States Patent [19]

Takahashi

[11] Patent Number: 5,443,194

[45] Date of Patent: Aug. 22, 1995

[54] METHOD OF CUTTING SHEET FOR PLOTTER

[75] Inventor: Isamu Takahashi, Tokyo, Japan

[73] Assignee: Mutoh Industries, Tokyo, Japan

[21] Appl. No.: 131,955

[22] Filed: Oct. 8, 1993

[30] Foreign Application Priority Data

Nov. 11, 1992 [JP] Japan ..... 4-326004

[51] Int. Cl.[6] ..... B26F 3/02

[52] U.S. Cl. ..... 225/2; 225/96; 225/106

[58] Field of Search ..... 225/2, 96, 96.5, 100, 225/106; 400/621, 621.1

[56] References Cited

U.S. PATENT DOCUMENTS

| | | | |
|---|---|---|---|
| 3,372,847 | 3/1968 | Walters et al. | 225/96.5 X |
| 3,659,766 | 5/1972 | Alago | 225/96 X |
| 5,133,615 | 7/1992 | Saito et al. | 400/621 |
| 5,188,009 | 2/1993 | Sunohara et al. | 83/56 X |

*Primary Examiner*—Eugenia Jones
*Attorney, Agent, or Firm*—Sughrue, Mion, Zinn, Macpeak & Seas; Richard C. Turner

[57] ABSTRACT

In case a long size sheet which is sandwiched by a drive roller and a pressure roller and its tip portion is suspended downwardly with its dead weight from the sheet support surface is cut off in a straight line in a crossing direction with a cutter pen of a plotter capable of shifting the sheet in a crossing direction, firstly, the sheet is cut off in a crossing direction with the cutter pen leaving a predetermined region at the center portion of the sheet. Next, a half-cut or perforation work is applied to the predetermined region at the center portion, and then, the drive roller is rotated in the positive or reverse direction, and the sheet transfers back and forth along its longitudinal direction, and the region of the sheet where the drawing has been performed is shaken off from the other portion of the sheet by the transfer, and thus, the cutting operation of the sheet is completed.

3 Claims, 5 Drawing Sheets

METHOD OF CUTTING SHEET FOR PLOTTER

PRIOR ART

In a paper-drive type plotter, a plotter provided with a cutter that cuts a rolled paper along a cut groove on a platen has been disclosed in Japanese Utility Model Laid-open No. 62-178194.

SUMMARY OF THE INVENTION

The present invention relates to a method of cutting a sheet for a sheet-drive type plotter provided with a paper cut mechanism.

In the foregoing conventional device, as shown in FIG. 8, a side 4*a* of a rolled paper 4 which is sandwiched by a drive roller and a pressure roller is firmly supported on their sheet support surfaces of these rollers with a portion of the paper to be cut with a cutter 2 as a border. However, a portion of a side 4*b* opposite of the sandwiched side 4*a* of the paper 4 is suspended downwardly from the sheet support surface which results in the downward shift of the cut end when the paper is cut by the weight of the paper 4 so that the paper cannot be cut beautifully in straight line.

An object of this invention is to allow a portion of a sheet of long size where a drawing has already been performed which is a side suspended with its dead weight from the sheet support surface is cut off beautifully in straight line in a crossing direction from a portion where a drawing has not been performed.

In a sheet-drive type plotter, the long size sheet is supported by a drive roller and a pressure roller, and a tip side portion of the sheet is suspended downwardly from the sheet support surface by the dead weight. When a cutter pen is shifted in a direction crossing the sheet, and the portion where a drawing has been performed at the tip side of the sheet is cut off from the side of the sheet sandwiched by the drive roller and the pressure roller, an invention of this application, firstly, cuts the sheet out in crossing direction leaving a predetermined region at the center portion of the sheet. Next, a controller cuts a predetermined region at the center of the sheet to apply a half-cut or perforation work (dotted line) with cutter pen. Next, the drive roller is caused to turn in the positive or reverse direction to shift the sheet back and forth in parallel to its longitudinal direction, the sheet undergoing a half-cut or perforation work at its center is separated from the side of the paper sandwiched by the drive roller and the pressure roller by the shift of the sheet.

DETAILED DESCRIPTION OF THE PREFERRED EMBODIMENTS:

The construction of this invention will be described in the following in detail by referring to embodiments illustrated in the attached drawings.

Figure 2:
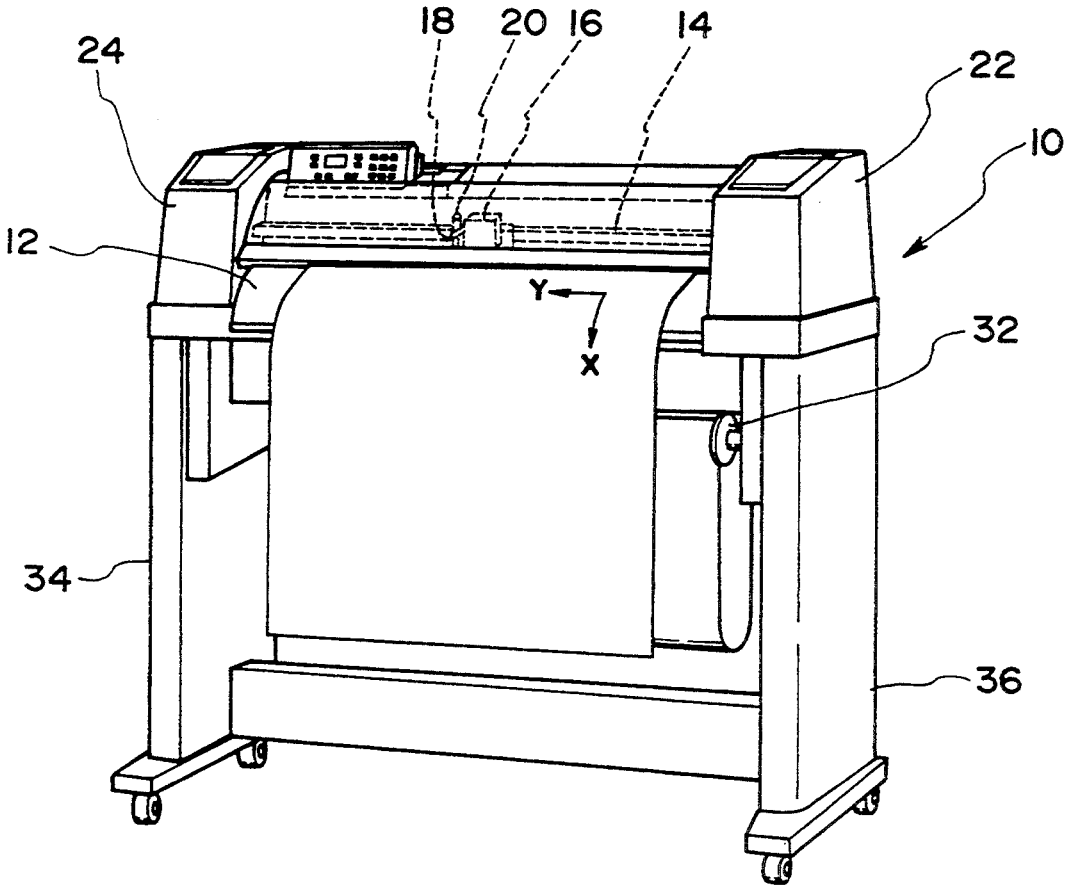
FIG. 2 is a general view of a pen plotter.

In FIG. 2, reference numeral 10 denotes a paper-drive type pen plotter, and a platen 12 is fixed to its body Numeral 14 denotes a Y rail installed on the body, and a drawing head 16 constituting a printing mechanism is shiftably mounted on the Y rail.

The drawing head 16 has a built-in lifting drive device such as a moving coil and the like, and this lifting drive device is connected to a pen holder 18 mounted liftably on the drawing head 16. The pen holder 18 has a writing pen or an edge, and is constructed to be able to hold detachably a cutter pen 20 having a holder portion of a shape identical with the writing pen.

At both sides of the body, a controller box 22 and a stocker housing box 24 are provided, and in the stocker housing box 24, a rotary type stocker (not shown in the drawing) holding a plurality of the writing pens or cutter pens detachably is disposed. Between the rotary type stocker and the drawing head 16, the exchange of pens is arranged to take place mutually and automatically.

A controller in the controller box 22 is connected to a host computer by means of an interface. At the inside of the platen 12, an underlying roller 26 and a drive roller 28 are rotatably disposed in relation with an X axis drive device, and each of the rollers 26 and 28 is disposed in a slit formed on the platen 12 in Y axial direction. Each of the rollers 26 and 28 is rotatably journalled on the body.

An arm liftably mounted on the Y rail 14 is rotatably journalled on a pressure roller 30, and the pressure roller 30 is resilient to the drive roller 28 by an elastic force of a spring. Numeral 32 denotes a sheet such as rolled paper.

Next, an operation of printing and drawing of the plotter will be described. The drawing operation of the plotter is carried out by a control of the controller on the basis of drawing data to be transferred to the controller of the plotter from the host computer. The pen holder 18 of the drawing head 16 holds the writing pen at the drawing time.

Figure 3:
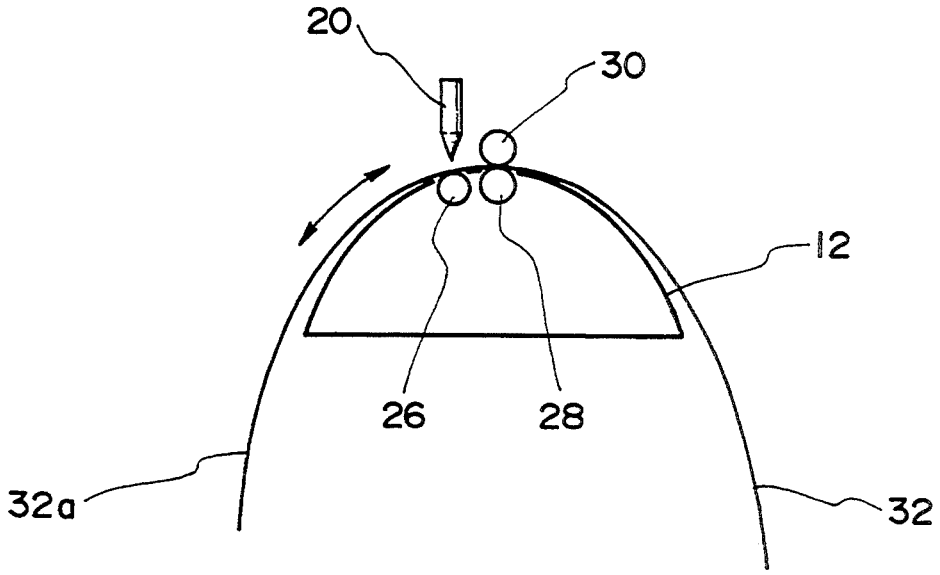
FIG. 3 is a side view of the pen plotter.

In the first place, the sheet 32 drawn out from a roll portion of the sheet 32 supported on leg portions 34 and 36 is mounted on the platen 12. When the drawing operation of the plotter starts, the pressure roller 30 applies a resilient force to the drive roller 28 from above the sheet 32, and the sheet 32 on the platen 12 is sandwiched by the drive roller 28 and the pressure roller 30. The sheet 32 is transferred in right and left directions (X axial direction) in FIG. 3 on the platen by positive or reverse rotation of the drive roller 28.

While the pen retained by the pen holder 18 is liftably controlled against the sheet 32 on the underlying roller 26, the pen is transferred in a direction (Y axial direction) crossing the sheet 32 along the Y rail 14, and an operation of a predetermined printing and drawing corresponding to one frame is taken place on the sheet 32. By the way, the pen holder 18 previously retains the cutter pen 20, and a cutting operation corresponding to one frame may be performed along the drawing locus by means of this cutter pen 20.

Next, as a gist of this invention, a cutting operation of separating a region where a drawing has been performed of one frame of the sheet 32 from a region where a drawing has not been performed of the sheet 32 will be described. When the controller shifts to a sheet cutting operation, the cutter pen 20 is retained on the pen holder 18 beforehand.

When the controller shifts to the sheet cutting operation, firstly, the drive of the drive roller 28 is controlled in the condition where the cutter pen 20 is lifted, and the portion undergoing the cutting of the border of the region where a drawing has been performed of the sheet 32 and the region where a drawing has not been performed is shifted to the lower part of the transfer locus of the cutter pen 20, namely, above the underlying roller 26.

Figure 1A:
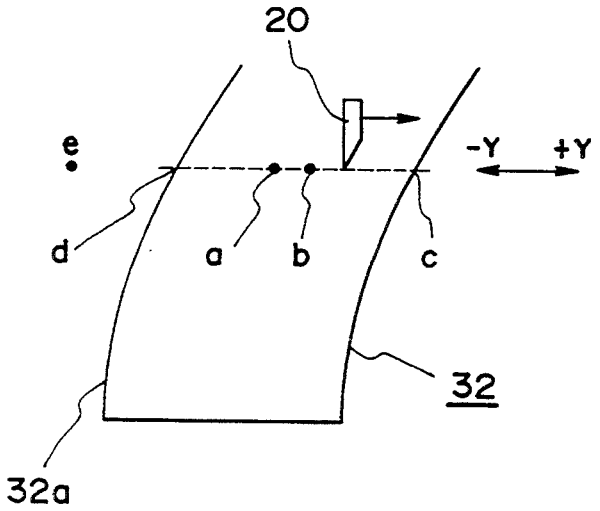
FIGS. 1A–1D is a drawing for explanation of this invention.

Next, the cutter pen 20 is shifted to a point e which is separated in a predetermined distance, the left direction from a left end d of the portion undergoing the cutting of the sheet 32 (refer to FIG. 1A). Next, the controller causes the cutter pen 20 to descend, and its tip is urged against the surface of the underlying roller 26.

And then, the controller causes the drawing head 16 to transfer in Y axial direction along the Y rail 14, and the cutter pen 20 advances to one end a of the region a–b of the sheet 32 to be cut. And then, the controller causes the cutter pen 20 to lift, and transfers the cutter pen 20 to the point b, and the cutter pen 20 is caused to descend to the point b, and the tip of the cutter pen 20 thrusts into the sheet 32.

Figure 1B:
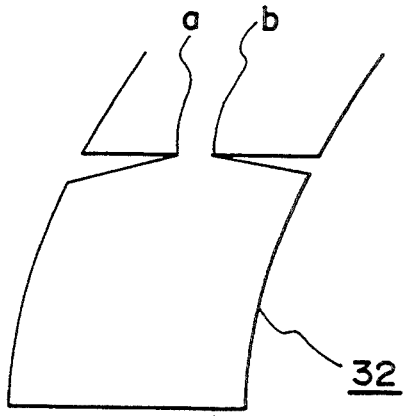

Next, the controller causes the drawing head 16 to transfer in +Y axial direction, and a portion between the point b and the point c of the sheet 32 is cut off with the cutter pen 20 (refer to FIG. 1B). Next, the controller transfers to the point a of the sheet 32 in the condition where the cutter pen 20 is lifted.

Figure 1C:
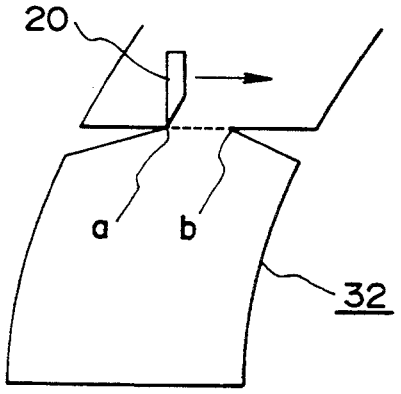

Next, the controller moves to cause the portion between the point a and the point b of the sheet 32 to be applied with a half-cut or perforation work (refer to FIG. 1C). This half-cut work weakens the writing pressure of the cutter pen 20 against the sheet 32 and arranges the edge of the cutter pen 20 to thrust into almost ½ of the sheet 32 in the thickness direction.

Figure 1D:
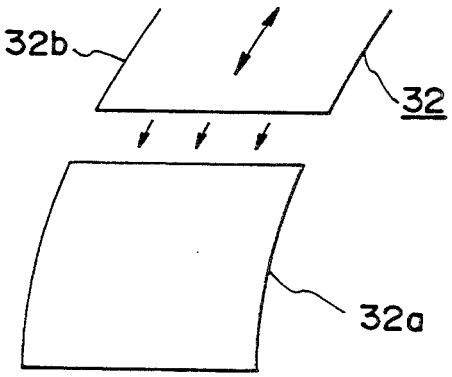

Next, the controller causes the cutter pen 20 to lift, and then, the drive roller 28 to rotate in the positive or reverse direction to rapidly shift the sheet 32 back and forth on the platen 12, and a region 32*a* where a drawing has been performed of the sheet 32 is shaken off from a region 32*b* where a drawing has not been performed (refer to FIG. 1D).

The shaking off operation of this sheet entails causing the sheet to vibrate at a speed sufficient to cause the region 32*a* to separate from the region 32*b*.

Figure 4:
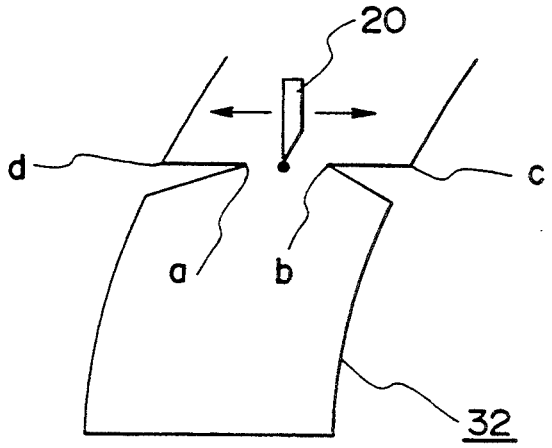
FIG. 4 is a drawing for explanation of another embodiment.

Also, an order of the cutting of the sheet is not limited to the foregoing embodiment, and, for example, the cutter pen 20 shifts in −Y direction from the point a of the sheet 32 and after cutting the portion between the point a and the point d, the cutter pen 20 transfers to the point b of the sheet 32, and the cutter pen 20 transfers in +Y direction from the point b, and with this transfer, the portion between the point a and the point b may be applied with a half-cut or perforation work (refer to FIG. 4).

Also, the pen plotter of this embodiment is of a construction that either of the writing pen or the cutter pen 20 is retained by the pen holder 18 of the drawing head 16, but may be of another construction that two pen holders are provided on the drawing head 16, and one pen holder is used exclusively for the writing pen, and the other pen holder is used exclusively for the cutter pen.

Figure 5:
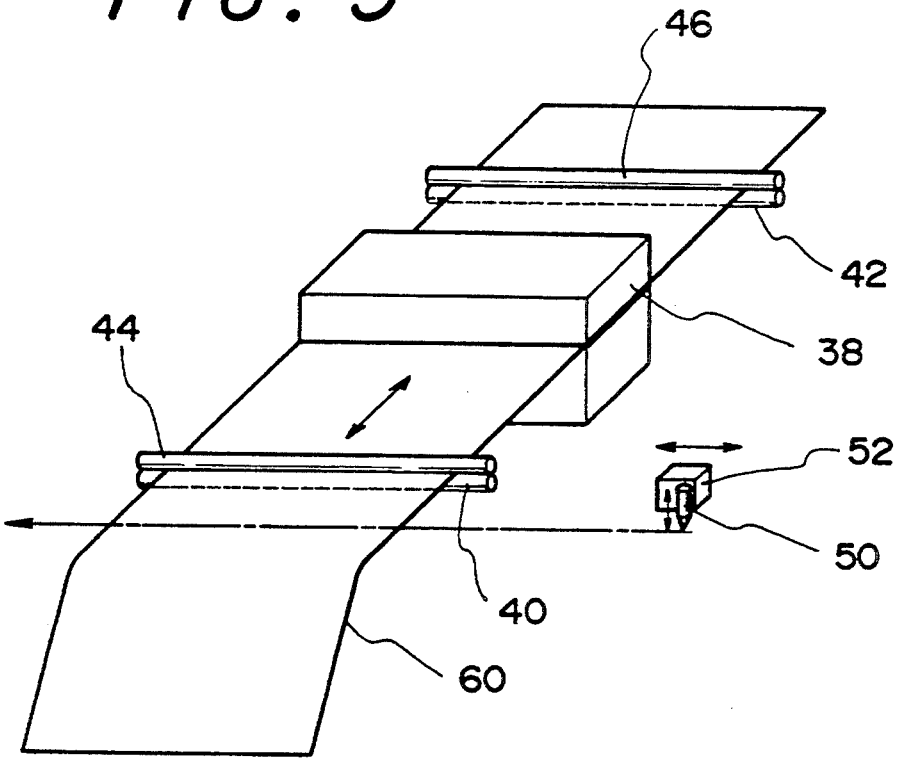
FIG. 5 is a general view of a raster plotter.
Figure 6:
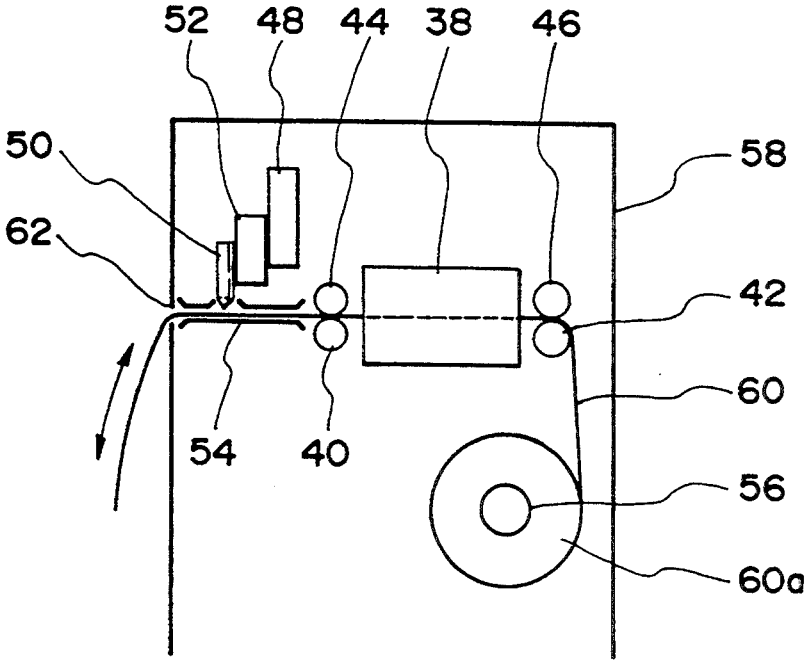
FIG. 6 is a side view of the raster plotter.

By the way, this invention may be applied to a raster plotter provided with a printing mechanism such as a thermal printing head, LED printing head or an ink jet printing head other than the foregoing pen plotter. FIG. 5 and FIG. 6 show a raster plotter. Numeral 38 denotes a raster type printing mechanism, and 40 and 42 denote drive rollers connected to a drive system, and 44 and 46 denote pressure rollers to be urged against the rollers 40 and 42.

Numeral 48 denotes a guide rail, and a cut unit 52 that holds a cutter 50 is shiftably mounted on the guide rail 48. Numeral 54 denotes a base. Numeral 56 denotes a sheet roll support means rotatably journalled on a body 58, and a roll portion 60*a* of a sheet 60 such as rolled paper and the like is supported on this support means 56.

The sheet 60 drawn out from the roll portion 60*a* is supplied to the printing mechanism 38 by the drive transfer rollers 40 and 42, and a predetermined printing operation is carried out. The sheet 60 on which the printing operation is carried out is discharged outside from an outlet 62 of the body 58 through the base 54 disposed on the body 58.

Figure 7:
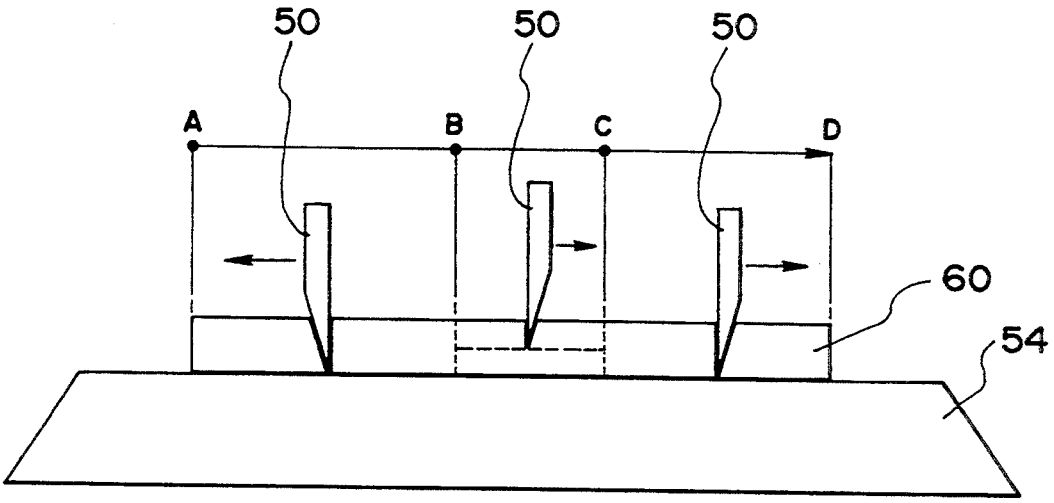
FIG. 7 is a drawing for explanation of operation of this invention.
Figure 8:
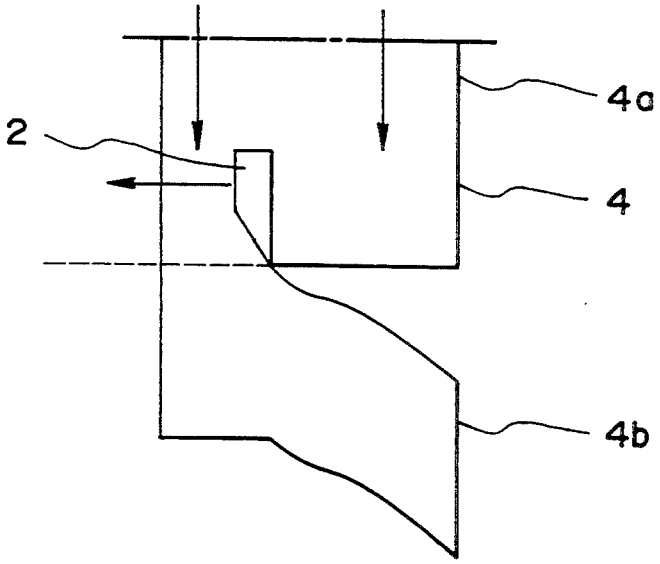
FIG. 8 PRIOR ART
FIG. 8 is a drawing for explanation of a prior art.

The discharge portion of the sheet 60 is suspended from the outlet 62 with its dead weight. When one frame region where printing and drawing have been performed on the sheet 60 is cut off from other continuous frames, the portion undergoing the cutting between the frames of the sheet 60 where the printing and drawing have been performed is positioned on a cutter transfer locus of the base 54 (refer to FIG. 7).

The controller of the raster plotter causes the cut unit 52 to transfer along the guide rail 48 and on the other hand, controls the lifting of the cutter 50 and the direction of the blade to cut the portion between the point A and the point B of the sheet 60 and then, cuts the portion between the point C and the point d, and the portion between the point B and the point C is applied with a half-cut or perforation work. Next, the drive roller 40 is rotated in the positive or reverse direction, and the printed and drawn region of one frame of the sheet 60 which is suspended from the outlet 62 is shaken off from the continuous sheet 60.

The present invention has an effect of cutting the sheet material beautifully because of its construction described in the foregoing.

What is claimed is:

1. A method of cutting a sheet which is sandwiched between a drive roller and a pressure roller, the method comprising the steps of:

rotating said drive roller to convey a portion of said sheet past said drive roller and said pressure roller in a longitudinal direction;

cutting said sheet along a transverse line such that said portion of said sheet is separated from a remaining portion of said sheet along all but a centrally located segment of the transverse line;

applying a half-cut or perforation to said sheet along the centrally located segment of the transverse line;

repeatedly rotating said drive roller in one direction and then in an opposite direction to convey said sheet back and forth in a longitudinal direction, thereby causing said portion of said sheet to separate from said remaining portion of said sheet along the centrally located segment of the transverse line.

2. The method according to claim 1, wherein said drive roller and said pressure roller are part of a plotter for printing on said sheet.

3. The method according to claim 2, wherein the plotter is a raster plotter.

* * * * *